US011406554B2

(12) United States Patent
Han et al.

(10) Patent No.: US 11,406,554 B2
(45) Date of Patent: Aug. 9, 2022

(54) KNEE JOINT REHABILITATION INSTRUMENT

(71) Applicant: HEXAR SYSTEMS CO., LTD., Ansan-si (KR)

(72) Inventors: Chang-Soo Han, Seoul (KR); Byung-Gab Ryu, Ansan-si (KR); Hye-Youn Jang, Gimpo-si (KR); Su-Hyun Park, Ansan-si (KR); Yong-Kyu Chi, Ansan-si (KR)

(73) Assignee: HEXAR SYSTEMS CO., LTD., Ansan-si (KR)

( * ) Notice: Subject to any disclaimer, the term of this patent is extended or adjusted under 35 U.S.C. 154(b) by 354 days.

(21) Appl. No.: 16/500,966

(22) PCT Filed: Nov. 9, 2017

(86) PCT No.: PCT/KR2017/012649
§ 371 (c)(1),
(2) Date: Oct. 4, 2019

(87) PCT Pub. No.: WO2018/186549
PCT Pub. Date: Oct. 11, 2018

(65) Prior Publication Data

US 2020/0030174 A1 Jan. 30, 2020

(30) Foreign Application Priority Data

Apr. 6, 2017 (KR) ..... 10-2017-0044691

(51) Int. Cl.
*A61H 1/02* (2006.01)

(52) U.S. Cl.
CPC ..... *A61H 1/024* (2013.01); *A61H 2201/1642* (2013.01); *A61H 2201/1645* (2013.01);
(Continued)

(58) Field of Classification Search
CPC ..... A61H 1/024; A61H 1/0218; A61H 2201/1624; A61H 2201/1645;
(Continued)

(56) References Cited

U.S. PATENT DOCUMENTS 5,280,783 A * 1/1994 Focht ..... A61H 1/0259 601/34
2005/0273022 A1* 12/2005 Diaz ..... A61H 1/0259 601/5

(Continued)

FOREIGN PATENT DOCUMENTS

CN 101128170 A 2/2008
CN 204521456 U 8/2015

(Continued)

OTHER PUBLICATIONS

Communication dated Feb. 2, 2021 by The State Intellectual Property Office of People's Republic of China in application No. 201780089389.3.

(Continued)

*Primary Examiner* — Samchuan C Yao
*Assistant Examiner* — Nathan M Le
(74) *Attorney, Agent, or Firm* — Sughrue Mion, PLLC

(57) ABSTRACT

The present invention relates to a knee joint rehabilitation instrument. The knee joint rehabilitation instrument of the present invention includes a thigh fixing unit into which a thigh of a leg requiring rehabilitation is inserted and thereby fixed; a shin fixing unit which is disposed next to the thigh fixing unit and into which a shin of the leg requiring rehabilitation is inserted and thereby fixed; and a knee position guide which is disposed between the thigh fixing unit and the shin fixing unit and guides a position of a knee when inserting the leg requiring rehabilitation into the thigh fixing unit and the shin fixing unit.

7 Claims, 11 Drawing Sheets

(52) U.S. Cl.
CPC ..... *A61H 2201/1678* (2013.01); *A61H 2201/5007* (2013.01)

(58) Field of Classification Search
CPC ..... A61H 2201/1642; A61H 2205/102; A61H 2201/1678; A61H 2201/0203
USPC ..... 601/23, 5; 602/16
See application file for complete search history.

(56) References Cited

U.S. PATENT DOCUMENTS

| | | | | |
|---|---|---|---|---|
| 2011/0009788 | A1* | 1/2011 | Kelly | A61F 5/0102 602/16 |
| 2011/0275043 | A1* | 11/2011 | Liu | A61H 1/024 434/247 |
| 2016/0367427 | A1 | 12/2016 | Malone | |

FOREIGN PATENT DOCUMENTS

| | | | |
|---|---|---|---|
| CN | 105617612 | A | 6/2016 |
| KR | 10-2010-0115287 | A | 10/2010 |
| KR | 10-2011-0060611 | A | 6/2011 |
| KR | 10-2011-0083416 | A | 7/2011 |
| KR | 10-2012-0103951 | A | 9/2012 |
| KR | 10-1352480 | B1 | 1/2014 |
| KR | 10-2014-0052882 | A | 5/2014 |
| KR | 10-1449612 | B1 | 10/2014 |
| KR | 10-2017-0017530 | A | 2/2017 |
| KR | 10-2016-0088987 | A | 7/2019 |

OTHER PUBLICATIONS

Korean Notice of Allowance for 10-2017-0044691 dated Jun. 19, 2019.
International Search Report for PCT/KR2017/012649 dated Feb. 22, 2018 (PCT/ISA/210).

* cited by examiner

KNEE JOINT REHABILITATION INSTRUMENT

CROSS REFERENCE TO RELATED APPLICATIONS

This application is a National Stage of International Application No. PCT/KR2017/012649 filed Nov. 9, 2017, claiming priority based on Korean Patent Application No. 10-2017-0044691, filed Apr. 6, 2017.

TECHNICAL FIELD

The present invention relates to a knee joint rehabilitation instrument, and more particularly, to a knee joint rehabilitation instrument capable of guiding a position of a knee when inserting a leg requiring rehabilitation, thus greatly improving ease of use.

BACKGROUND ART

If a knee joint is unable to move for a long time due to a fracture or surgery of the knee joint, it may be weakened and hardened over time.

In addition, when the walking muscle strength or joint parts are weakened due to aging, not due to accident or surgery, and thus it become difficult to walk, walking is gradually reduced, whereby a knee joint may become weak and harden.

It is not easy to return a hardened knee joint to an initial state thereof. Accordingly, when a knee joint is weakened and hardened due to accident, surgery, or aging, it is necessary to exercise, i.e., rehabilitate, the knee joint.

In this case, since it is difficult to rehabilitate a knee joint alone, a knee joint rehabilitation instrument may be used.

In the case of knee joint rehabilitation instruments proposed in existing technologies, it is not easy to, when inserting a leg requiring rehabilitation, correctly position the leg due to structural limitations thereof. In fact, it is difficult to efficiently carry out knee rehabilitation exercises when a knee is not placed in a correct position.

DISCLOSURE

Technical Problem

The present invention is directed to providing a knee joint rehabilitation instrument capable of guiding a position of a knee when inserting a leg requiring rehabilitation, thus greatly improving ease of use.

Technical Solution

In accordance with an aspect of the present invention, the above and other objects can be accomplished by the provision of a knee joint rehabilitation instrument, including: a thigh fixing unit into which a thigh of a leg requiring rehabilitation is inserted and thereby fixed; a shin fixing unit which is disposed next to the thigh fixing unit and into which a shin of the leg requiring rehabilitation is inserted and thereby fixed; and a knee position guide which is disposed between the thigh fixing unit and the shin fixing unit and guides a position of a knee when inserting the leg requiring rehabilitation into the thigh fixing unit and the shin fixing unit.

The knee position guide is preferably connected to the thigh fixing unit.

The thigh fixing unit may include an elastic belt-type thigh unit band for tightening and fixing a thigh; and thigh shock absorbers disposed on an inner wall of the elastic belt-type thigh unit band and configured to cushion and support the thigh tightened by the elastic belt-type thigh unit band. In this case, the knee position guide is preferably connected to the thigh shock absorbers.

The thigh shock absorbers may include a lower thigh shock absorber for cushioning and supporting a lower part of a thigh; and an upper thigh shock absorber for cushioning and supporting an upper part of a thigh. In this case, the knee position guide is preferred to be integrally formed with the upper thigh shock absorber.

The knee position guide may include a guide extension connected to the upper thigh shock absorber and configured to outwardly extend from the thigh unit band toward the shin fixing unit; and a knee guide hole formed at the guide extension such that a knee is visible.

The knee joint rehabilitation instrument may further include a pair of unit supports for supporting both sides of the thigh fixing unit and the shin fixing unit; a motor connected to a center of one rotation shaft; and a controller for controlling a rotation operation of the motor based on a predetermined input signal.

The knee joint rehabilitation instrument may further include a pair of length-adjustable stands respectively connected to the pair of unit supports; and a pair of length-adjustable bases for supporting the pair of length-adjustable stands with respect to the ground.

The knee joint rehabilitation instrument may further include shin fixing unit position adjusters connected to a shin fixing unit support constituting a lower part of the shin fixing unit and, on the unit supports, configured to adjust a position of the shin fixing unit support such that the shin fixing unit support is fitted at a center of a shin of a patient.

The knee joint rehabilitation instrument may further include an angle adjuster provided with an angle adjusting lever for adjusting an angle of the thigh fixing unit.

Advantageous Effects

As apparent from the above description, a knee joint rehabilitation instrument according to the present invention can guide a position of a knee when inserting a leg requiring rehabilitation, thus greatly improving ease of use. In particular, a front part of a knee can be positioned in a part seen through a knee guide hole in the knee position guide when a user looks down, so that the user can easily wear the knee position guide alone.

MODES OF THE INVENTION

Descriptions of a disclosed technology are only embodiments for structural or functional description, the scope of the disclosed technology should not be construed as limited by the embodiments described in the text. That is, the embodiments may be variously modified and may have various forms, and thus, the scope of the disclosed technology should be understood to include equivalents capable of realizing the technical idea.

Meanwhile, terms described in this application should be understood as follows. Terms such as "first" and "second" are to distinguish one component from another component, and the scope of the present invention should not be limited by these terms. These terms are only used to distinguish one element from another element. For example, a first element may be termed a second element and a second element may be termed a first element without departing from the teachings of the present invention.

It will be understood that when an element, such as a layer, a region, or a substrate, is referred to as being "connected to" another element, it may be directly connected to the other element or intervening elements may be present. In contrast, when an element is referred to as being "directly connected to" another element or layer, there are no intervening elements or layers present. Meanwhile, other words used to describe the relationship between elements or layers should be interpreted in a like fashion (e.g., "between," versus "directly between," "adjacent," versus "directly adjacent," etc.).

The expression of singularity in the present specification includes the expression of plurality unless clearly specified otherwise in context. Also, terms such as "include" or "comprise" may be construed to denote a certain characteristic, number, step, operation, component, or a combination thereof in the specification, but may not be construed to exclude the presence or possibility of addition of one or more other characteristics, numbers, steps, operations, components, or combinations thereof.

Each step may occur differently from a stated order unless the specific order is definitely disclosed in context. That is, each step may occur in the same order as specified, may be performed substantially simultaneously, or may be performed in reverse order.

Unless otherwise defined, all terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1:
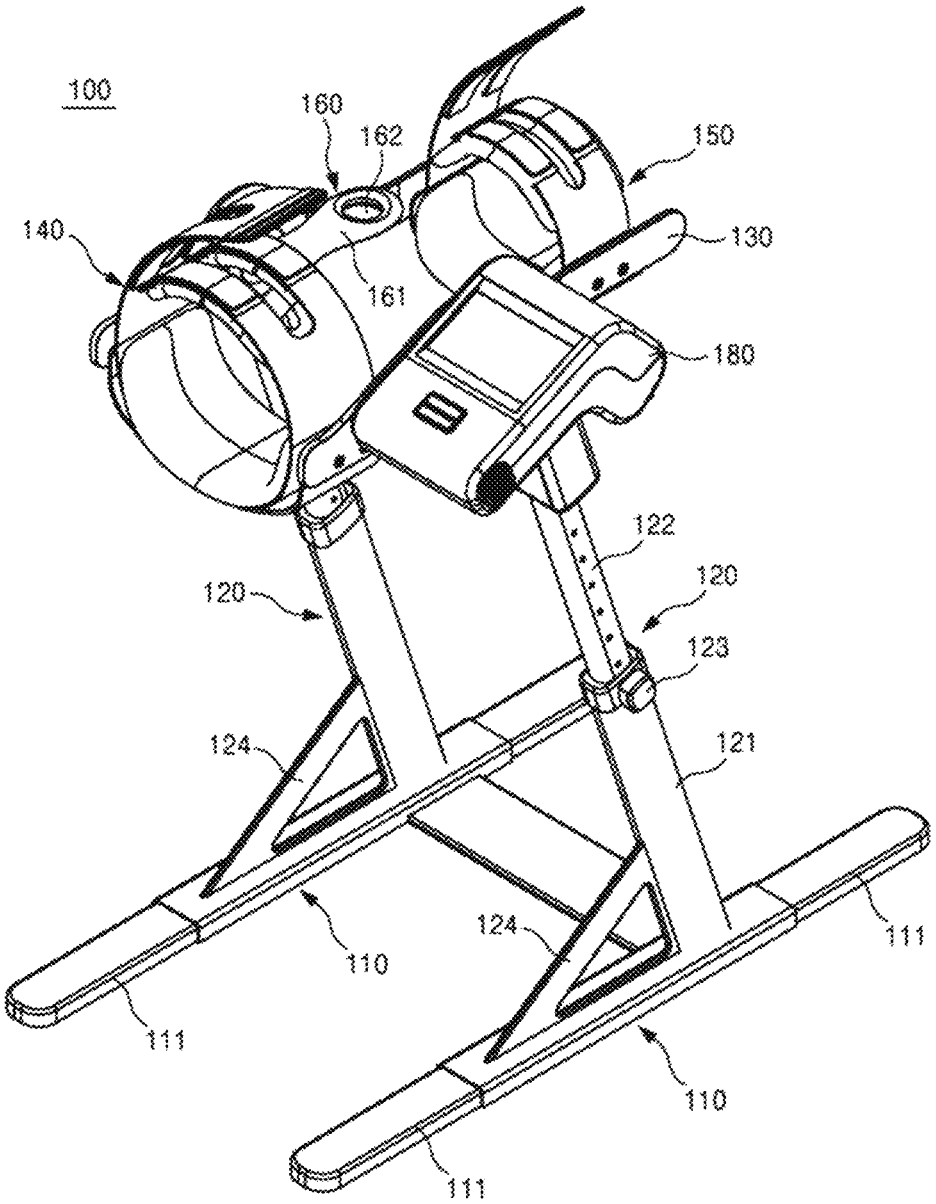
FIG. 1 illustrates a perspective view of a knee joint rehabilitation instrument according to an embodiment of the present invention.
Figure 2:
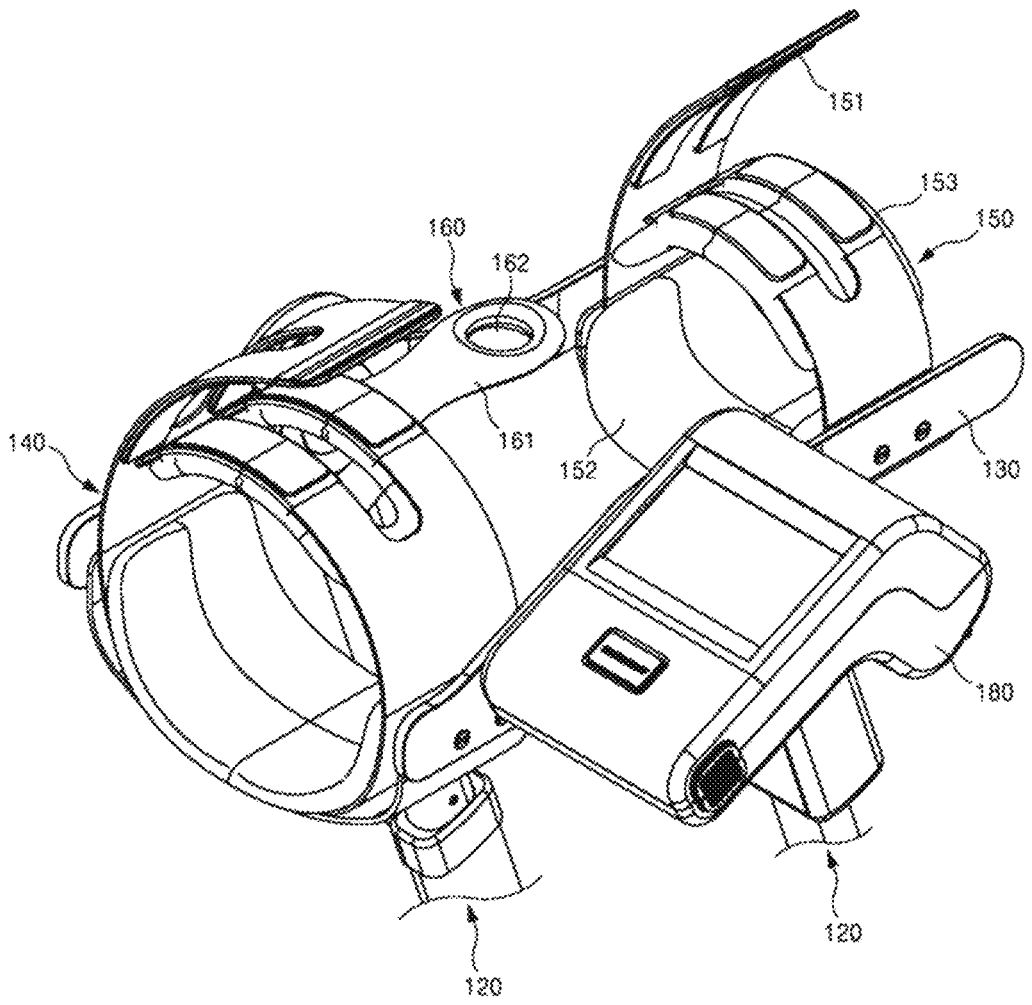
FIG. 2 illustrates an enlarged view of a main component of the knee joint rehabilitation instrument of FIG. 1.
Figure 3:
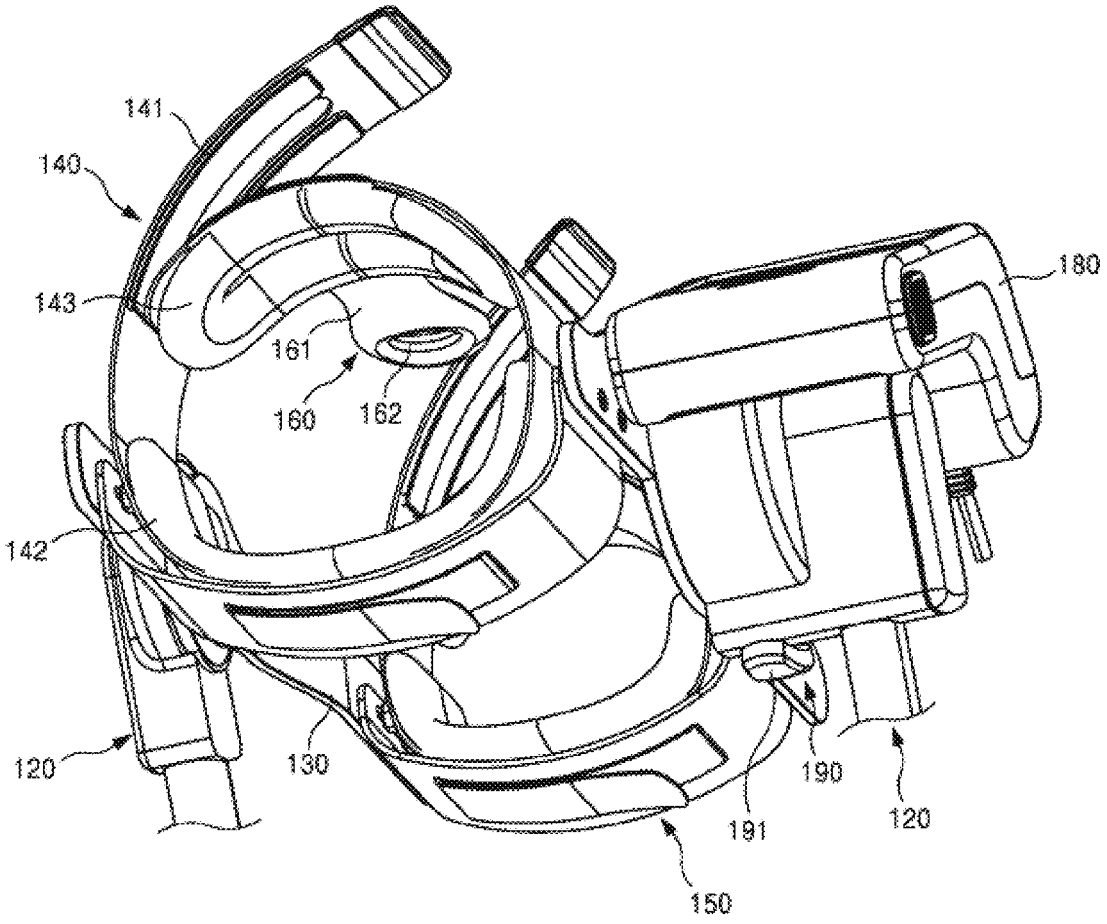
FIG. 3 illustrates the main component of FIG. 2 shown from a different angle.
Figure 4:
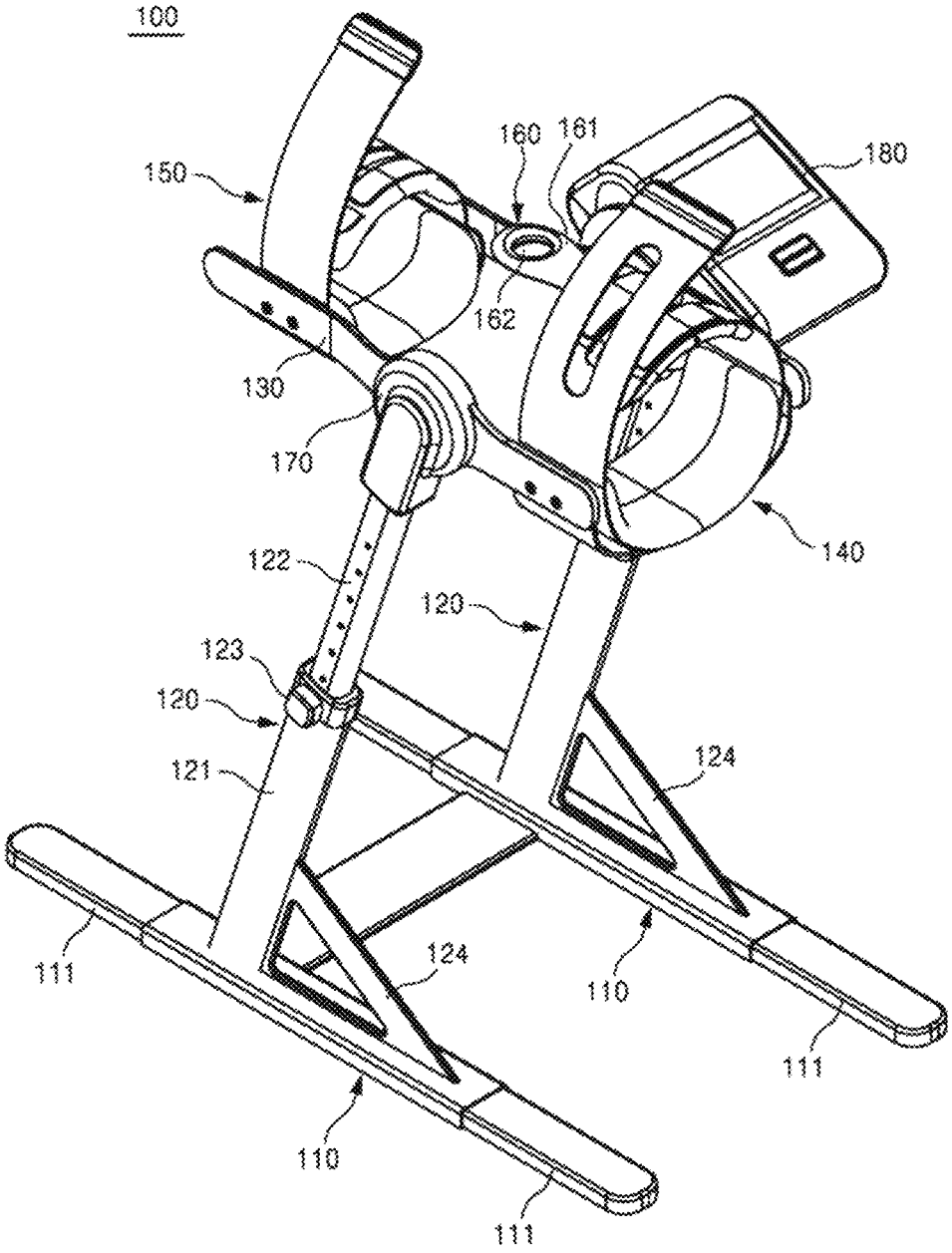
FIG. 4 illustrates a back perspective view of the knee joint rehabilitation instrument of FIG. 1.
Figure 5:
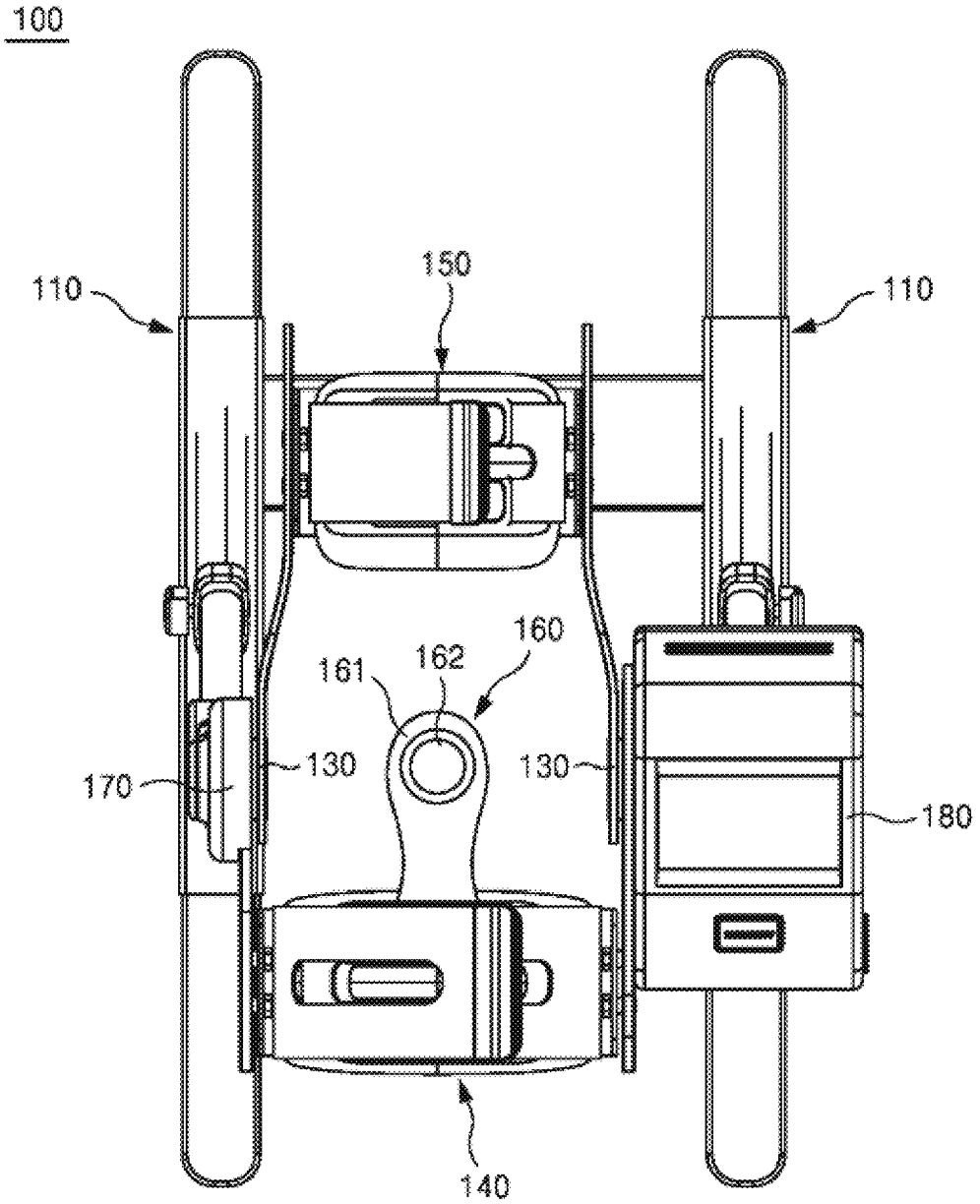
FIG. 5 illustrates a plan view of the knee joint rehabilitation instrument of FIG. 1.
Figure 6:
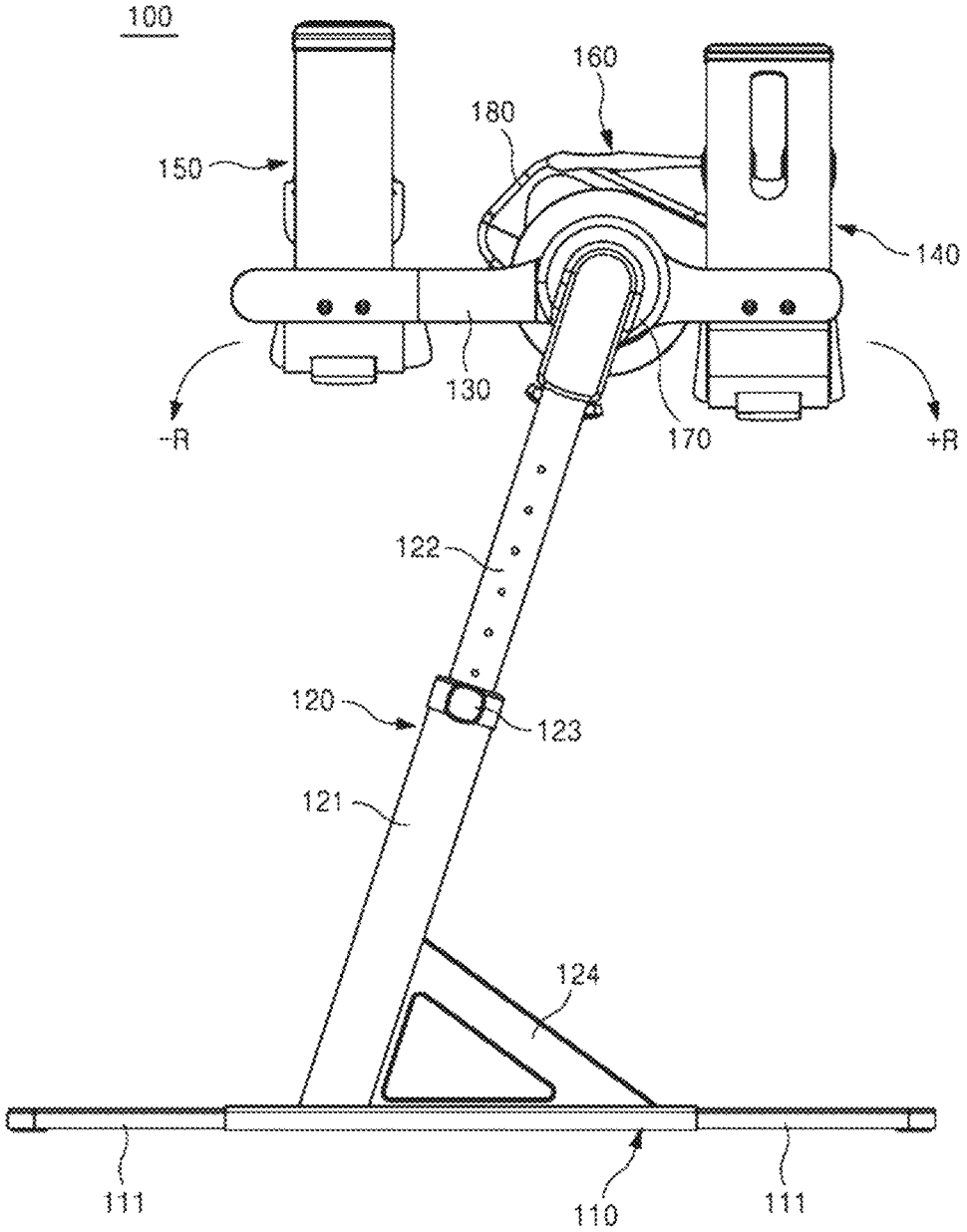
FIG. 6 illustrates a side view of the knee joint rehabilitation instrument of FIG. 1.
Figure 7:
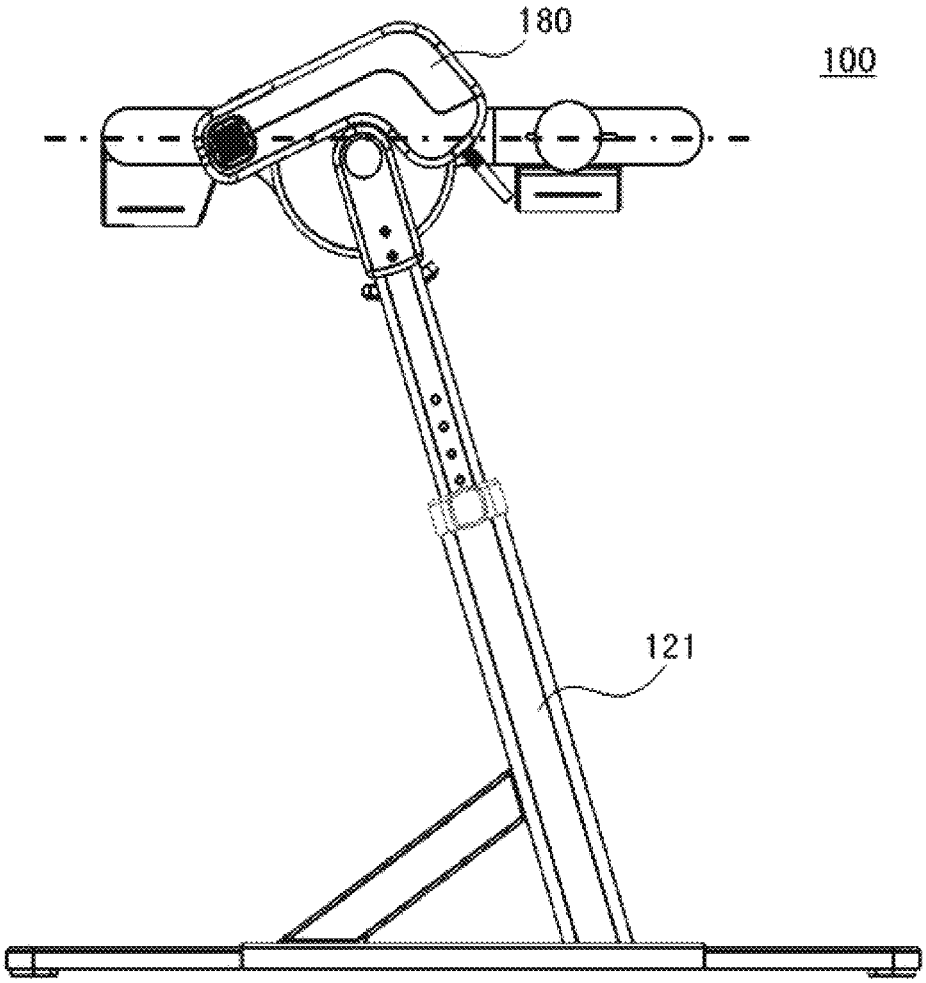
FIG. 7 and FIG. 8 are images illustrating a process in which an angle of a thigh fixing unit is adjusted.
Figure 8:
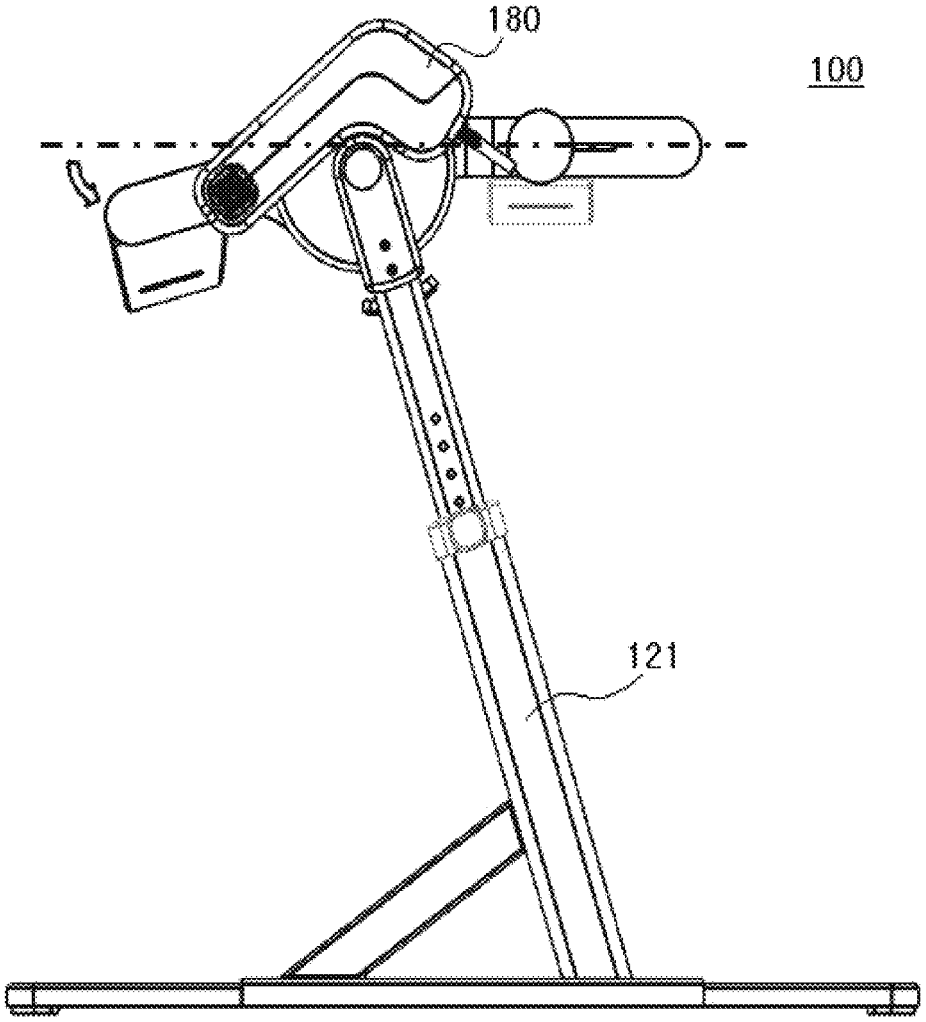
Figure 9:
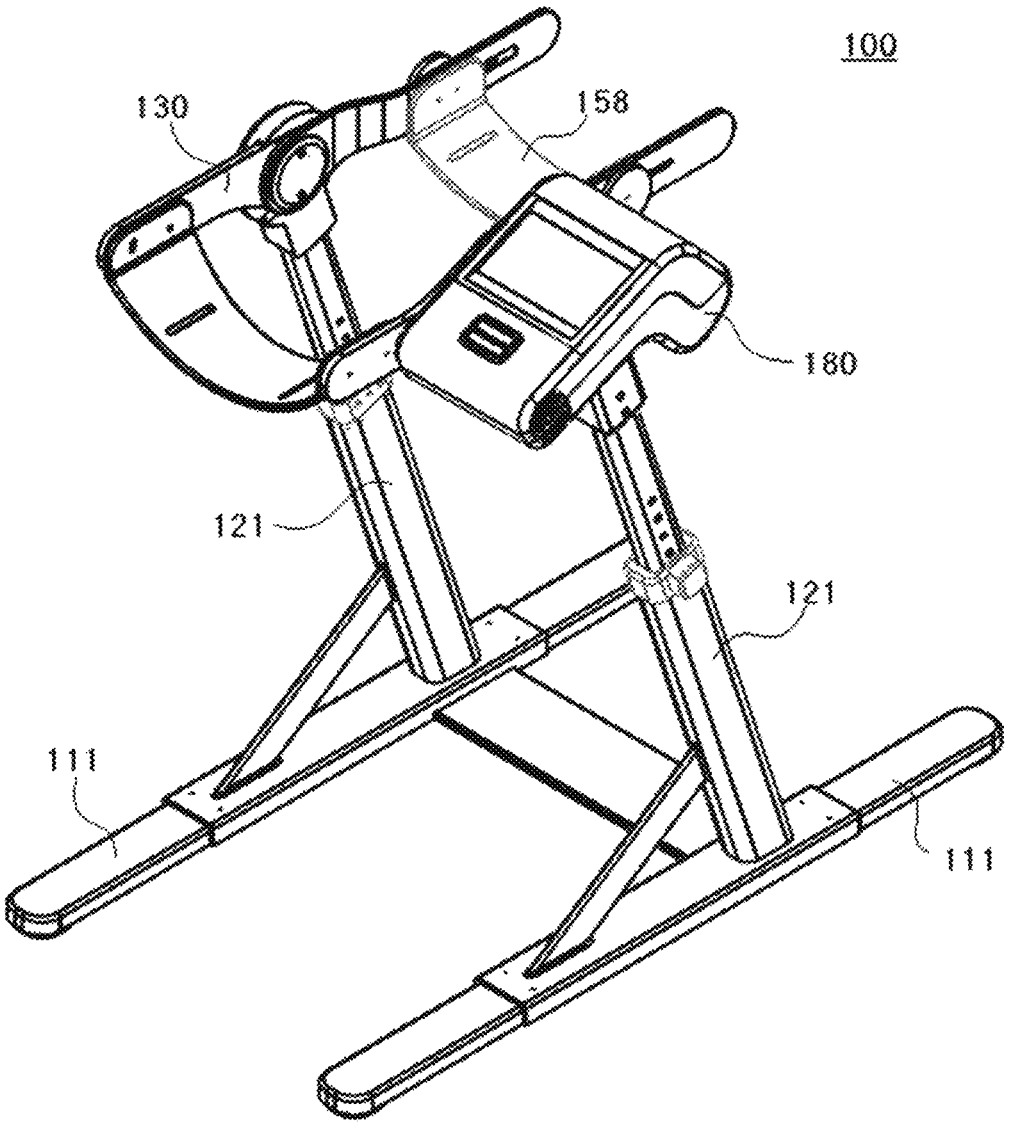
FIG. 9 is a structural view illustrating position adjustment of a shin fixing unit support.
Figure 10:
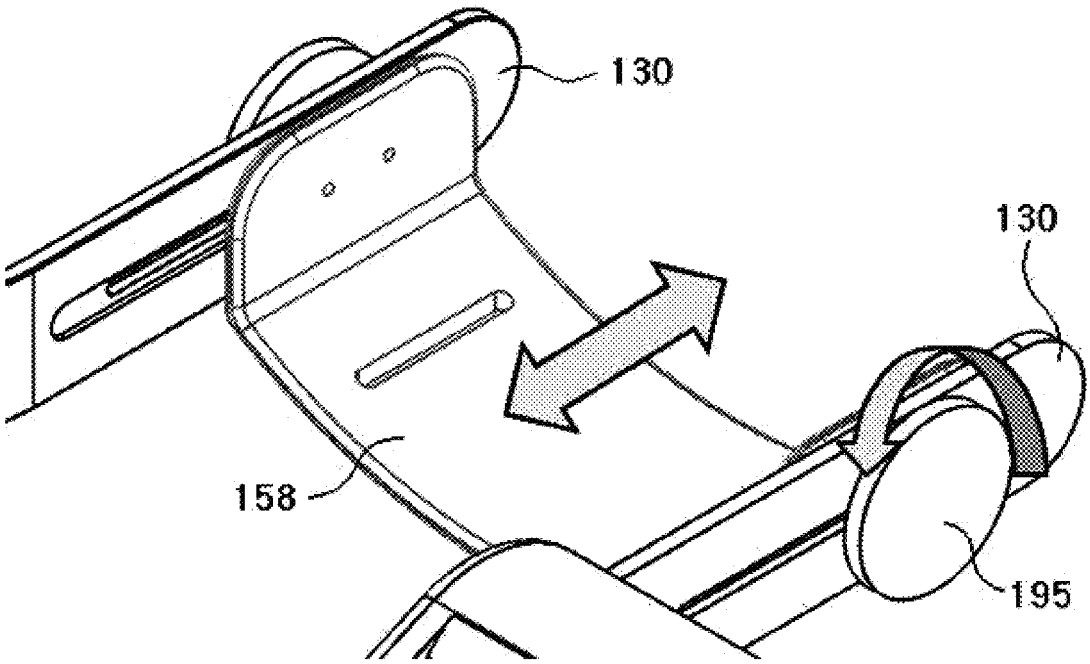
FIG. 10 is an enlarged view illustrating a shin fixing unit position adjuster part of the shin fixing unit support of FIG. 9.
Figure 11:
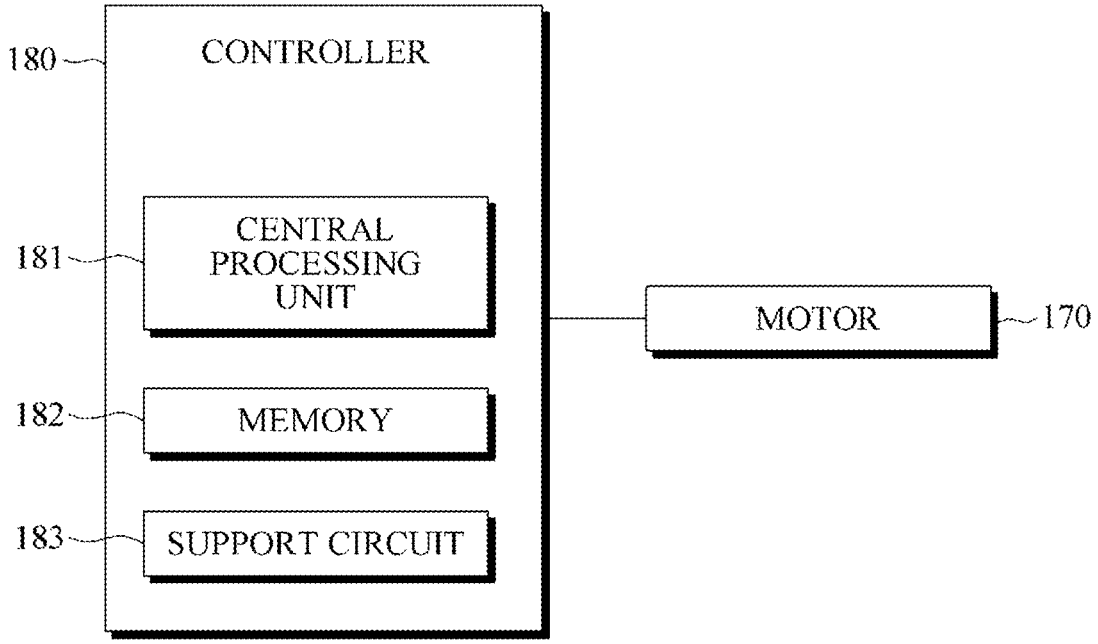
FIG. 11 illustrates a control block diagram of a knee joint rehabilitation instrument according to an embodiment of the present invention.

Hereinafter, the present invention will be described in detail with reference to the accompanying drawings. FIG. 1 illustrates a perspective view of a knee joint rehabilitation instrument according to an embodiment of the present invention, FIG. 2 illustrates an enlarged view of a main component of the knee joint rehabilitation instrument of FIG. 1, FIG. 3 illustrates the main component of FIG. 2 shown from a different angle, FIG. 4 illustrates a back perspective view of the knee joint rehabilitation instrument of FIG. 1, FIG. 5 illustrates a plan view of the knee joint rehabilitation instrument of FIG. 1, FIG. 6 illustrates a side view of the knee joint rehabilitation instrument of FIG. 1, FIG. 7 and FIG. 8 are images illustrating a process in which an angle of a thigh fixing unit is adjusted, FIG. 9 is a structural view illustrating position adjustment of a shin fixing unit support, FIG. 10 is an enlarged view illustrating a shin fixing unit position adjuster part of the shin fixing unit support of FIG. 9, and FIG. 11 is a block diagram illustrating a controller and motor of a knee joint rehabilitation instrument according to an embodiment of the present invention.

Referring to the drawings, a knee joint rehabilitation instrument 100 according to an embodiment of the present invention may guide a position of a knee when inserting a leg requiring rehabilitation, thereby greatly improving ease of use and may include a thigh fixing unit 140 and a shin fixing unit 150 for respectively fixing a thigh and a shin, and a knee position guide 160 for guiding a position of a knee.

A thigh of a leg requiring rehabilitation is inserted into the thigh fixing unit 140 and fixed thereby. In addition, a shin of the leg requiring rehabilitation is inserted into the shin fixing unit 150 and fixed thereby.

Since a thigh is thicker than a shin, the structures of the thigh fixing unit 140 and the shin fixing unit 15 may be substantially the same except that the size of the thigh fixing unit 140 is larger than that of the shin fixing unit 150.

Here, the sizes may be diameters.

First, examining the thigh fixing unit 140, the thigh fixing unit 140 includes an elastic belt-type thigh unit band 141 for tightening and fixing a thigh; and thigh shock absorbers 142 and 143 disposed on an inner wall of the thigh unit band 14 land configured to cushion and support a thigh tightened by the thigh unit band 141.

Here, the thigh shock absorbers 142 and 143 may include a lower thigh shock absorber 142 for cushioning and supporting a lower part of a thigh; and an upper thigh shock absorber 143 for cushioning and supporting an upper part of a thigh. An upper part of a thigh refers to a part of a thigh located in the front of the body, and a lower part of a thigh refers to a part of a thigh located in back of the body.

Of course, the lower thigh shock absorber 142 and the upper thigh shock absorber 143 may be manufactured in one piece without being separated from each other.

The shin fixing unit 150 is manufactured in an almost similar shape to the structure of the thigh fixing unit 140 described above. That, the shin fixing unit 150 may also include an elastic belt-type shin unit band 151 for tightening and fixing a shin; and shin absorbers 152 and 153 disposed on an inner wall of the shin unit band 151 and configured to cushion and support a shin tightened by the shin unit band 151.

The shin absorbers 152 and 153 may include a lower shin absorber 152 for cushioning and supporting a lower part of a shin; and an upper shin absorber 153 for cushioning and supporting an upper part of a shin. As in the thigh shock absorbers 142 and 143, the lower shin absorber 152 and the upper shin absorber 153 may also be manufactured in one piece without being separated from each other.

Meanwhile, the knee position guide 160 is disposed between the thigh fixing unit 140 and the shin fixing unit 150 and serves to guide a position of a knee when inserting a leg requiring rehabilitation into the thigh fixing unit 140 and the shin fixing unit 150.

A leg inserted into and fixed by the thigh fixing unit 140 and the shin fixing unit 150 is rotated by a motor 170 in a +R or -R direction of FIG. 6, whereby a rehabilitation exercise for a knee joint may be performed. Here, it is important to correctly position a knee.

It is not difficult for a person who can freely move the knee to correctly position the knee, but it is not easy for a person requiring knee rehabilitation to correctly position the knee on a target site.

Accordingly, the knee position guide 160 according to the embodiment is required. When the knee position guide 160 is provided as in this embodiment, it is easy to correctly position a knee, whereby a rehabilitation exercise for a knee joint may be efficiently performed.

In the embodiment, the knee position guide 160 may be connected to the thigh fixing unit 140. That is, the knee position guide 160 may be integrally formed with the upper thigh shock absorber 143.

The knee position guide 160 may include a guide extension 161 connected to the upper thigh shock absorber 143 and configured to outwardly extend from the thigh unit band 141 toward the shin fixing unit 150; and a knee guide hole 162 formed at the guide extension 161 such that a knee is visible.

When the knee position guide 160 is integrally formed with the upper thigh shock absorber 143 in such a manner, the upper thigh shock absorber 143 may be molded together with the knee position guide 160 to facilitate a manufacturing process.

In addition, the knee position guide 160 may be placed at a correct position by simply installing the upper thigh shock absorber 143 at a target position, avoiding the need to install an additional device.

By forming the knee guide hole 162 in the knee position guide 160, a front part of a knee may be positioned at an area seen through the knee guide hole 162 when a user looks down, thereby increasing ease of use.

Meanwhile, in the embodiment, rehabilitation of a knee joint is performed in a sitting state. That is, unlike products used in a lying state, a leg requiring rehabilitation is fixed to the knee joint rehabilitation instrument 100 in a sitting state to perform rehabilitation in the embodiment.

Accordingly, the knee joint rehabilitation instrument 100 according to the embodiment is used as a stand type. For this, the knee joint rehabilitation instrument 100 is provided with unit supports 130, length-adjustable stands 120, and length-adjustable bases 110.

The unit supports 130 serve to support both sides of the thigh fixing unit 140 and the shin fixing unit 150.

In addition, the length-adjustable stands 120 are respectively connected to a pair of the unit supports 130 so that a length of the knee joint rehabilitation instrument 100 is adjustable. The length-adjustable stands 120 include stand holders 121; moving stand bars 122 respectively connected to the stand holders 121 such that lengths of the moving stand bars 122 can be extended or shortened; and bolt members 123 for respectively controlling the moving stand bars 122. The stand holders 121 are installed to be inclined, and supports 124 are respectively connected to the stand holders 121 to support the same.

Accordingly, the bolt members 123 are tightened after adjusting the lengths of the moving stand bars 122 by loosening the bolt members 123 so that the length-adjustable stands 120 may be used to fit a body size of a user.

The length-adjustable bases 110 support a pair of the length-adjustable stands 120 with respect to the ground and have an adjustable length structure. That is, the pair of length-adjustable bases 110 are respectively provided with horizontal length adjusters 111, lengths of which are extended or shortened. Due to the horizontal length adjusters 111, an interference phenomenon of the length-adjustable bases 110 according to the position of a chair may be addressed.

Meanwhile, a motor 170 is located at the center of one rotation shaft of the pair of unit supports 130. The motor 170 is inserted into the thigh fixing unit 140 and the shin fixing unit 150 and may perform knee rehabilitation while rotating a fixed leg in a +R or −R direction of FIG. 6.

Such a motor 170 may be controlled by a controller 180. The controller 180 may include a central processing unit (CPU) 181, a memory 182, and a support circuit 183.

The CPU 181 may be one of various computer processors that may be industrially applied to control a rotation operation of the motor 170 based on a predetermined input signal in the embodiment.

The memory 182 is a computer-readable recording medium and may be installed locally or remotely. For example, the memory 182 may be at least one readily available memory such as RAM, ROM, a floppy disk, a hard disk, or any digital storage form.

The support circuit 183 is combined with the CPU 181 to support typical processor operations. Such a support circuit 183 may include a cache, a power supply, a clock circuit, an input/output circuit, a subsystem, and the like.

In the embodiment, the controller 180 controls a rotation operation of the motor 170 based on a predetermined input signal. A series of such processes and the like may be stored in the memory 182. Typically, software routines may be stored in the memory 182. Software routines may be stored in or executed by another central processing unit (not shown).

Meanwhile, as illustrated in FIGS. 3 and 7 to 10, the knee joint rehabilitation instrument 100 according to the embodiment is further provided with an angle adjuster 190 and shin fixing unit position adjusters 195.

The angle adjuster 190 serves to adjust the angle of the thigh fixing unit 140 according to user's convenience, as shown in FIGS. 3, 7, and 8.

Such an angle adjuster 190 includes an angle adjusting lever 191. The angle of the thigh fixing unit 140 may be adjusted by clockwise or counterclockwise operations of the angle adjusting lever 191.

Here, since the thigh fixing unit 140 is fixed to the controller 180, the angle of the controller 180 may also be simultaneously adjusted when the angle of the thigh fixing unit 140 is adjusted, as shown in FIGS. 7 and 8.

In addition, referring to FIGS. 9 and 10, the knee joint rehabilitation instrument 100 according to the embodiment may be further provided with shin fixing unit position adjusters 195.

The shin fixing unit position adjusters 195 are connected to a shin fixing unit support 158 constituting a lower part of the shin fixing unit 150 and, on the unit supports 130, serve to adjust a position of the shin fixing unit support 158 such that the shin fixing unit support 158 is fitted at the center of a shin of a patient. Since the shin fixing unit position adjusters 195 are bolt types, the shin fixing unit position adjusters 195 are loosened by rotating in an arrow direction of FIG. 10, and then re-tightened after adjusting a position of the shin fixing unit support 158.

Due to such configurations, a knee of a leg requiring rehabilitation may be placed at a correct position through the knee position guide 160, and the leg may be fixed to the thigh fixing unit 140 and the shin fixing unit 150, followed by performing knee rehabilitation exercise (CPM) by rotational force of the motor 170 through the controller 180.

In accordance with the embodiment having the aforementioned structures and functions, a position of a knee may be guided when inserting a leg requiring rehabilitation, thereby greatly improving ease of use.

In particular, in accordance with the embodiment, a front part of a knee may be located at a part seen through the knee guide hole in the knee position guide when a user looks down, whereby the user may easily wear the knee joint rehabilitation instrument alone.

In addition, since rehabilitation may be performed in a state in which a knee is located at a correct position, rehabilitation effects may be improved.

It will be apparent to those skilled in the art that the scope of the present invention is not limited to the disclosed embodiments and various changes and modifications can be made to the embodiments without departing from the spirit or scope of the invention. Therefore, the changes and modifications should be interpreted as being included in the accompanying claims.

The invention claimed is:

1. A knee joint rehabilitation instrument, comprising:

a thigh fixing unit into which a thigh of a leg of a user requiring rehabilitation is inserted and thereby fixed, the leg requiring rehabilitation;

a shin fixing unit into which a shin of the leg requiring rehabilitation is inserted and thereby fixed, the shin fixing unit being positioned in a first direction from the thigh fixing unit; and a knee position guide which is disposed between the thigh fixing unit and the shin fixing unit and guides a position of a knee of the user when inserting the leg requiring rehabilitation into the thigh fixing unit and the shin fixing unit, wherein the thigh fixing unit includes an upper thigh shock absorber for cushioning and supporting an upper part of the thigh and a lower thigh shock absorber for cushioning and supporting a lower part of the thigh, wherein the upper part of the thigh refers to a part of the thigh located in a front of the leg, and the lower part of the thigh refers to a part of the thigh located in a back of the leg, and wherein the knee position guide includes:

a guide extension connected to the upper thigh shock absorber and extending from the upper thigh shock absorber toward the shin fixing unit in the first direction, the guide extension including a first end portion and a second end portion and extending from the first end portion to the second end portion in the first direction, and a knee guide hole formed at the second end portion of the guide extension and facing a second direction vertical to the first direction such that a front part of the knee is visible to the user through the knee guide hole.

2. The knee joint rehabilitation instrument according to claim 1, wherein the thigh fixing unit comprises an elastic belt-type thigh unit band for tightening and fixing the thigh; and wherein the upper and lower thigh shock absorbers are disposed on an inner wall of the elastic belt-type thigh unit band and configured to cushion and support the thigh tightened by the elastic belt-type thigh unit band.

3. The knee joint rehabilitation instrument according to claim 2, wherein the knee position guide is integrally formed with the upper thigh shock absorber.

4. The knee joint rehabilitation instrument according to claim 1, further comprising a pair of unit supports for supporting both sides of the thigh fixing unit and the shin fixing unit; a motor connected to a center of one rotation shaft; and a controller for controlling a rotation operation of the motor based on a predetermined input signal.

5. The knee joint rehabilitation instrument according to claim 4, further comprising a pair of length-adjustable stands respectively connected to the pair of unit supports; and a pair of length-adjustable bases for supporting the pair of length-adjustable stands with respect to the ground.

6. The knee joint rehabilitation instrument according to claim 4, further comprising shin fixing unit position adjusters connected to a shin fixing unit support constituting a lower part of the shin fixing unit and, on the unit supports, configured to adjust a position of the shin fixing unit support such that the shin fixing unit support is fitted at a center of the shin of the user.

7. A knee joint rehabilitation instrument, comprising:

a thigh fixing unit into which a thigh of a leg of a user is inserted and thereby fixed, the leg requiring rehabilitation;

a shin fixing unit into which a shin of the leg requiring rehabilitation is inserted and thereby fixed, the shin fixing unit being positioned in a first direction from the thigh fixing unit; and a knee position guide which is disposed between the thigh fixing unit and the shin fixing unit and guides a position of a knee of the user when inserting the leg requiring rehabilitation into the thigh fixing unit and the shin fixing unit, wherein an angle of the thigh fixing unit is adjusted by a motor, wherein the thigh fixing unit includes an upper thigh shock absorber for cushioning and supporting an upper part of the thigh and a lower thigh shock absorber for cushioning and supporting a lower part of the thigh, wherein the upper part of the thigh refers to a part of the thigh located in a front of the leg, and the lower part of the thigh refers to a part of the thigh located in a back of the leg, and wherein the knee position guide includes:

a guide extension connected to the upper thigh shock absorber and extending from the upper thigh shock absorber toward the shin fixing unit in the first direction, the guide extension including a first end portion and a second end portion and extending from the first end portion to the second end portion in the first direction, and a knee guide hole formed at the second end portion of the guide extension and facing a second direction vertical to the first direction such that a front part of the knee is visible to the user through the knee guide hole.

* * * * *